US005766648A

United States Patent [19]

Eriksson et al.

[11] Patent Number: 5,766,648

[45] Date of Patent: Jun. 16, 1998

[54] ROAD TRANSPORTABLE SEGMENTAL CONCRETE RAILROAD TIE LONG-LINE PRODUCTION SYSTEM

[75] Inventors: Anders L. U. Eriksson, Calgary, Canada; Derek Firth, Coeur d'Alene, Id.; Rick W. Petersen; John G. White, both of Spokane, Wash.

[73] Assignee: CXT Incorporated, Spokane, Wash.

[21] Appl. No.: 731,828

[22] Filed: Oct. 21, 1996

[51] Int. Cl.[6] ..... B28B 23/06

[52] U.S. Cl. ..... 425/111; 264/228; 425/62; 425/182

[58] Field of Search ..... 264/228; 425/62, 425/111, 182

[56] References Cited

U.S. PATENT DOCUMENTS

| | | | |
|---|---|---|---|
| 4,040,775 | 8/1977 | Nordbak | 425/111 |
| 4,051,216 | 9/1977 | Bratchell | 264/157 |
| 4,149,306 | 4/1979 | Tice | 425/111 |
| 4,421,710 | 12/1983 | Borcoman | 425/111 |
| 4,812,113 | 3/1989 | Jantzen | 425/111 |

OTHER PUBLICATIONS

"New Mobile Concrete Tie Plant," Aug. 1986, p. 38.
"Twin Mould Method," Costain Concrete Co., Ltd., Dec. 1980.
"Dutch Firm Introduces Portable Precast Plant," Concrete, May 1984, pp. 43 and 54.
Dywidag, Germany, Cycles, published prior to Oct. 1, 1995.
Otto–Verken, "Otto–Verken's other Activities," Sweden, published prior to Oct. 1, 1995.
The Concrete Alternative, "Background," Sweden, published prior to Oct. 1, 1995.
Bureau BBR Ltd., "BBR Prestressed Concrete Railway Sleepers," Switzerland, published prior to Oct. 1, 1995.
Dipl.–Ing Werner Bruckner, Thosti–BBRV, "Design, Manufacture and Use of Thosti–BBRV Prestressed Concrete Sleeper," with insert, published prior to Oct. 1, 1995.

*Primary Examiner*—James P. Mackey
*Attorney, Agent, or Firm*—Wells, St. John, Roberts, Gregory & Matkin P.S.

[57] ABSTRACT

A road transportable concrete railroad long-line tie molding system is described in which a rigid horizontal metal stressing frame is assembled from transportable sub-frame segments. The sub-frame segments are releasably connected in axially aligned end-to-end relation, and include parallel longitudinal reaction members. In a preferred form, the sub-frame segments are convertible from inoperative transport conditions to extended operative conditions. Footings are provided along the stressing frame length to engage the sub-frame segments to releasably mount the sub-frame segments in axial alignment and stabilize the reaction members against lateral deflection during compressive loading. A plurality of conventional gang tie molds having upwardly open elongated mold cavities are releasably received in end-to-end alignment along the framework. A reinforcing wire anchor is provided on the sub-frame at the dead end of the framework and a tensioner is located at the live end of the framework. The tensioner and anchors are adapted to receive and position an array of longitudinal reinforcing wires within the mold cavities. The wires are placed in tension against the reaction members, which react in compression. Both tension and compression forces are isolated from the tie molds. The tensioning forces applied between the tensioner and anchors are distributed about a centroid. The reaction members are positioned in concentricity with the centroid to avoid eccentric loading of the reaction members.

16 Claims, 7 Drawing Sheets

ROAD TRANSPORTABLE SEGMENTAL CONCRETE RAILROAD TIE LONG-LINE PRODUCTION SYSTEM

TECHNICAL FIELD

The present invention relates to roadway transportable segmental reinforcing wire stressing frames and form supports which combine for long-line production of concrete railroad ties.

BACKGROUND OF THE INVENTION

Concrete railroad ties are steadily gaining increased use as replacements for wooden ties. Concrete ties have many acknowledged advantages over wooden ties. However, the significant weight differential between concrete and wooden ties can be a determining factor in deciding which will be used in particular geographic areas. Concrete ties are substantially heavier and are consequently more costly to transport than wooden ties.

The most economic method used currently to produce concrete railroad ties is the "long-line" method. In a nutshell, the long-line method involves the use of numerous tie molds placed end-to-end along a stressing bed. This arrangement enables all wires in one mold cavity to be tensioned in one procedure only, regardless of the length of the stressing bed.

In long-line permanent concrete tie making plants, reinforcing wires are disposed along the full length of the frame in sets, one for each column of longitudinally aligned tie forms. The forces required to prestress the long reinforcing wires necessitate a carefully engineered and massive stressing frame that, if fairly large numbers of ties are to be produced economically, must span a considerable distance. In permanent tie production facilities, the stressing frame will often span several hundred feet, and be produced as a permanent, in ground structure using several hundred tons of concrete and reinforcing steel in the process. Such stressing frames are not at all practical, if not impossible, to transport from one production site to another.

One solution to the problem of providing stressing frames is to simply construct permanent type stressing frames at the remote site. This is inefficient in that the number of ties that can be produced for one or two projects is significantly less in comparison to what may be produced at permanent facilities on a continuous basis. Once a sufficient number of ties have been produced at the remote site, the poured-in-place stressing frames remain and must be somehow disposed of at substantial cost.

Other solutions offer special concrete tie forms with built-in stressing frame capability. While this eliminates the need to dispose of temporary stressing frames, the forms themselves are heavy and therefore costly to build, transport and handle. Additionally, such "short-line" production methods are affected by the need to repeatedly perform functions for singular, or small numbers of ties, whereas the long-line method requires the same performance only once per stressing frame and casting cycle.

The short-line production method demonstrates significantly lower labor productivity as well as much higher wire wastage in comparison to the long-line method.

A need has remained for portable concrete tie plants that will allow for production of concrete ties at sites geographically closer to the locations at which the produced ties are to be used. Such plants have been produced and used on a limited basis. However, to the best of the applicants' knowledge, until advent of the present invention, no portable concrete tie production facilities have been developed that are economically feasible. This is because economical long-line production techniques have not been adapted to portable concrete tie production facilities or equipment.

A need also remains for a portable long-line tie production structure that is constructed of portable stressing frames that are easy to transport on ordinary roadways, are quick to set up, that emulate permanent long-line tie making facilities to allow for interchangeability of certain equipment and parts, and that can be easily broken down and transported for re-use at another site.

The present system fills the above needs, as will be understood from the following description.

BRIEF DESCRIPTION OF THE DRAWINGS

Preferred embodiments of the invention are described below with reference to the following accompanying drawings.

FIG. 4 is an end transverse sectional view of a preferred form of the present invention, with reaction members folded to a transport condition;

FIG. 7 is a fragmented perspective view of a dead end segment and an adjacent sub-frame segment of the preferred system; and FIG. 8 is an operational end view.

DETAILED DESCRIPTION OF THE PREFERRED EMBODIMENTS

Figure 1:
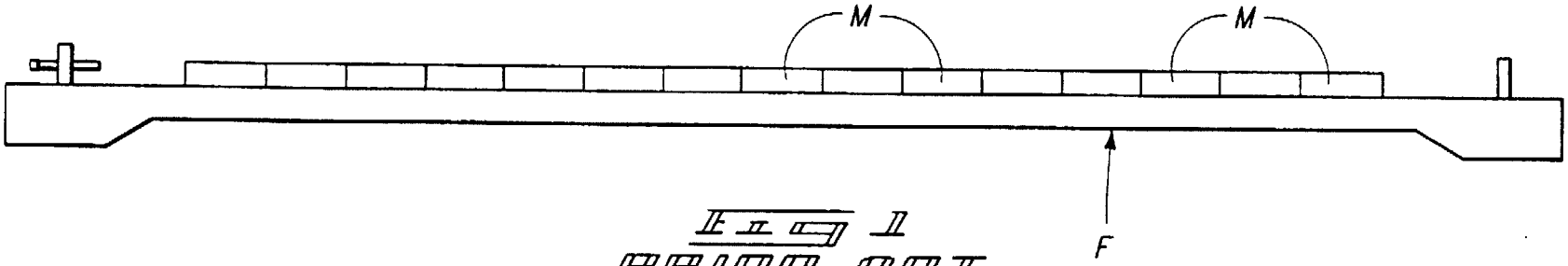
FIG 1 PRIOR ART
FIG. 1 is a schematic side elevation view illustrating the stressing bed of a permanent prior art concrete tie production facility.

This disclosure of the invention is submitted in furtherance of the constitutional purposes of the U.S. Patent Laws "to promote the progress of science and useful arts" (Article 1, Section 8).

A road transportable, segmental concrete railroad tie mold support and wire tensioning structure is generally illustrated by the reference numeral 10 in the accompanying drawings. The structure 10 is unique in its ability to be transported by ordinary roadway surfaces from one site to another, and in its construction which will allow prestressing of reinforcing wires for long-line production of concrete railroad ties. An exemplary tie is illustrated in FIG. 3.

Figure 2:
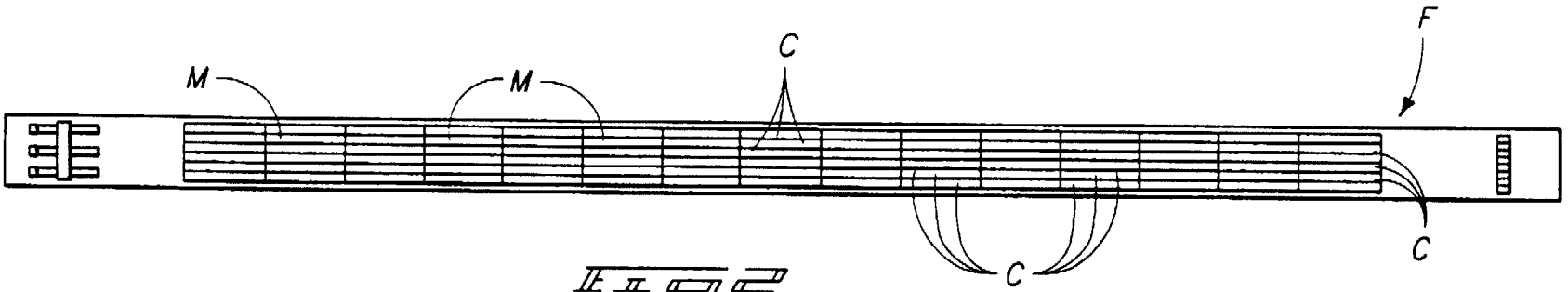
FIG 2 PRIOR ART
FIG. 2 is a simplified top plan view of the prior art stressing bed.

It is also intended that the present structure 10 maintain numerous characteristics of conventional stationary long-line concrete railroad tie producing plants, a schematic of which is illustrated in FIGS. 1 and 2. In permanent plants, a massive concrete stressing frame F extends between opposed ends where even more massive footings are provided. Hundreds of tons of concrete and reinforcing steel are used in these structures, which are formed and poured substantially below the ground surface to provide by means of mass and rigidity sufficient resistance to eccentric loading that occurs during prestressing reinforcing wires for the concrete ties.

It is typical that numerous gang tie molds M are positioned along the permanent stressing frame F and are joined end to end with mold cavities C aligned to receive multiple lengths of prestressed wire that are strained over the full length of the stressing frame. Conventional bulkheads (not shown) are added to the molds after the wire is placed, to separate individual tie molds along the length of the frame. The gang molds are filled with concrete once the wires have been prestressed within the cavities. The concrete is allowed to set for a time before the bulkheads are removed. Upon completed curing, the wires are detensioned, and are cut at opposed ends of each formed tie to free the individual ties and allow the individual gang molds to be handled in a de-molding process step.

Figure 3:
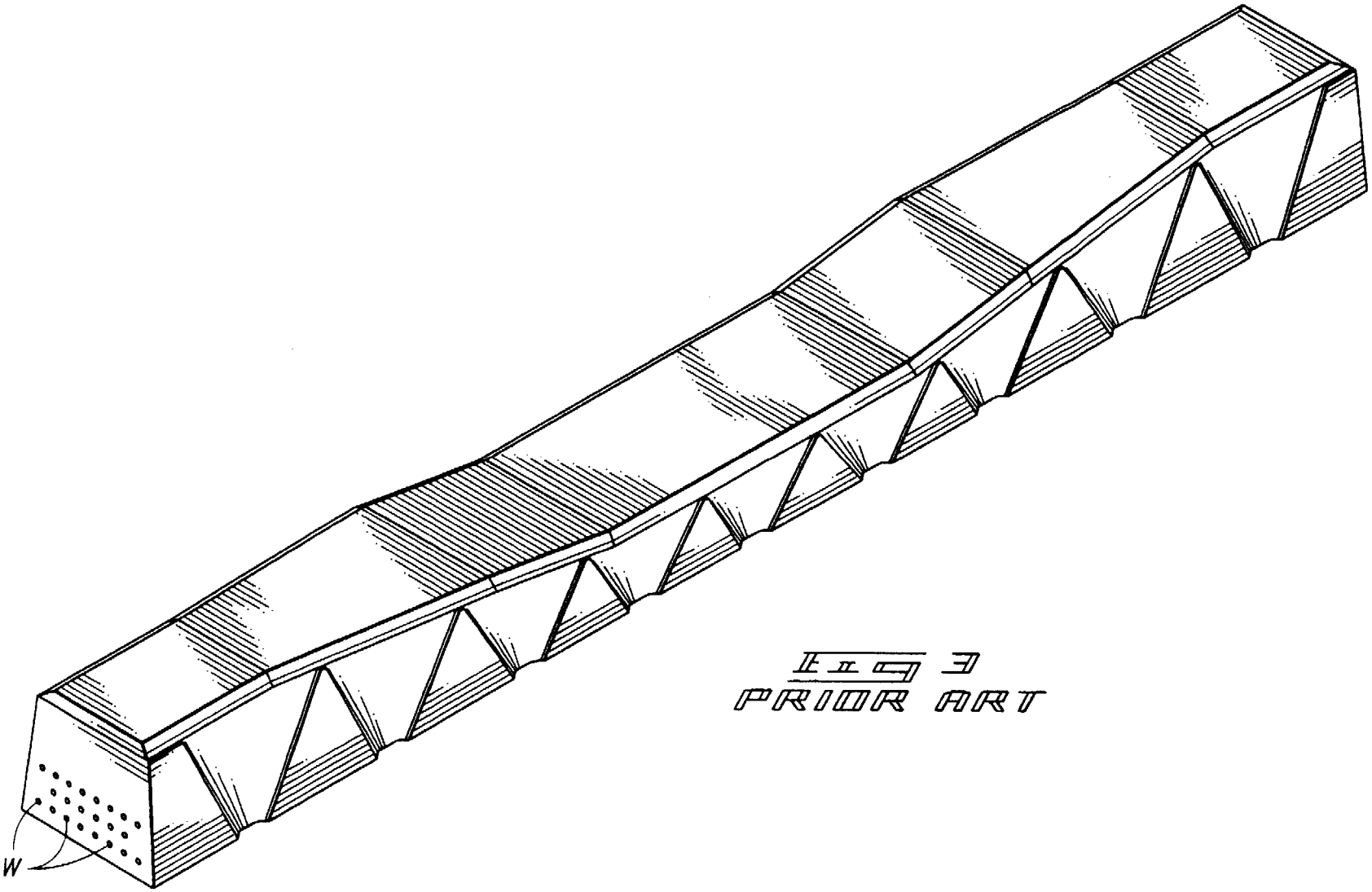
FIG 3 PRIOR ART
FIG. 3 is a perspective view of a concrete tie.
Figure 3:
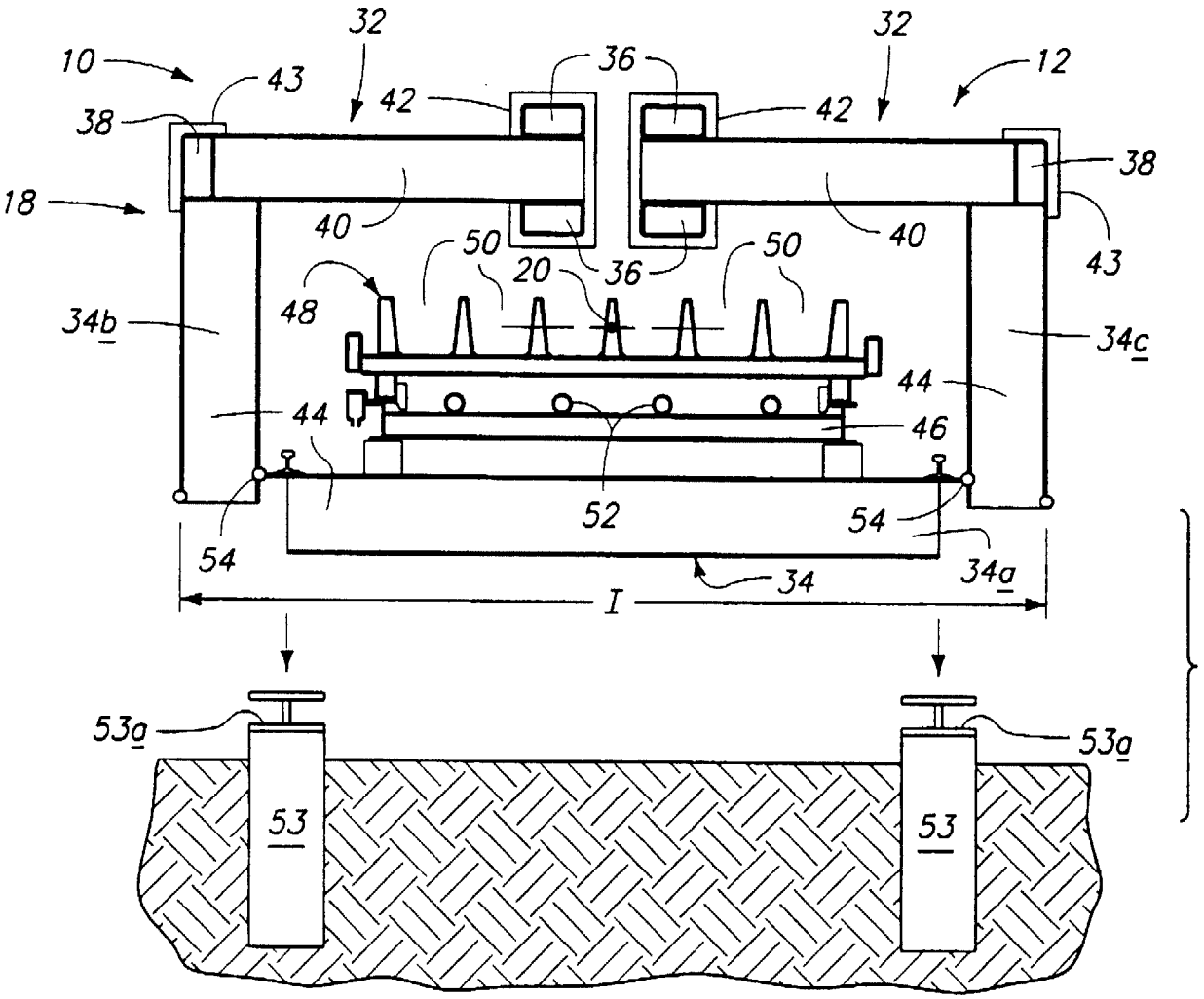

An exemplary tie produced, using long-line production techniques is shown in FIG. 3. Here the cut ends of 22 reinforcing wires W are shown. The wires W are cut at the ends of the ties following the casting process, after the bulkheads have been removed.

Many of the prior art long-line gang mold configurations, bulkheads, casting equipment, wire cutting apparatus, de-molding apparatus, stressing devices, etc. may be used by the present structure 10, thereby eliminating need for construction or purchase of additional equipment and training of personnel. This is especially advantageous for operators of conventional stationary long-line tie producing facilities who wish to incorporate a portable tie making capability.

Figure 6:
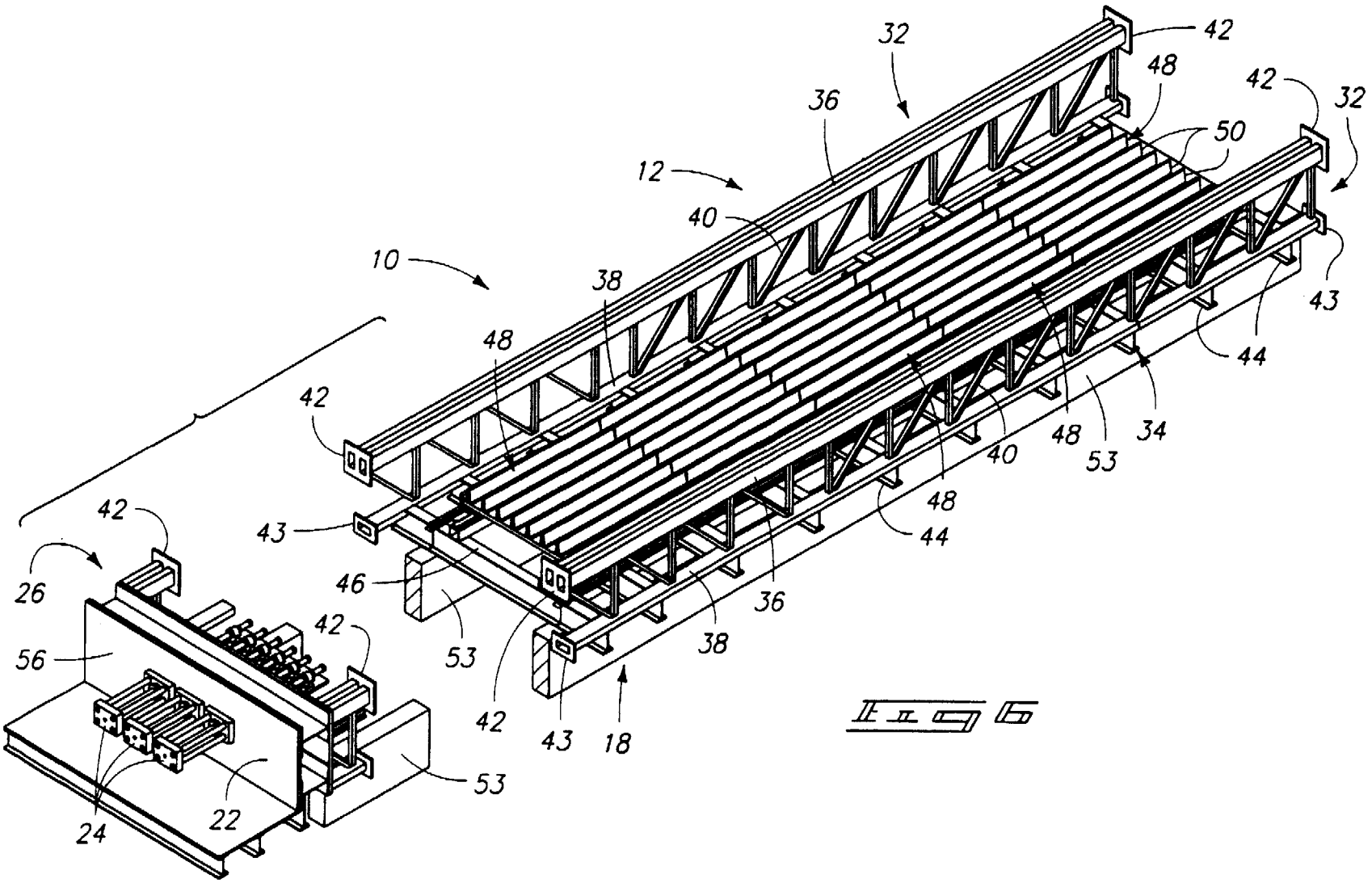
FIG. 6 is a fragmented perspective view of a live end segment and an adjacent sub-frame segment of the preferred system.
Figure 11:
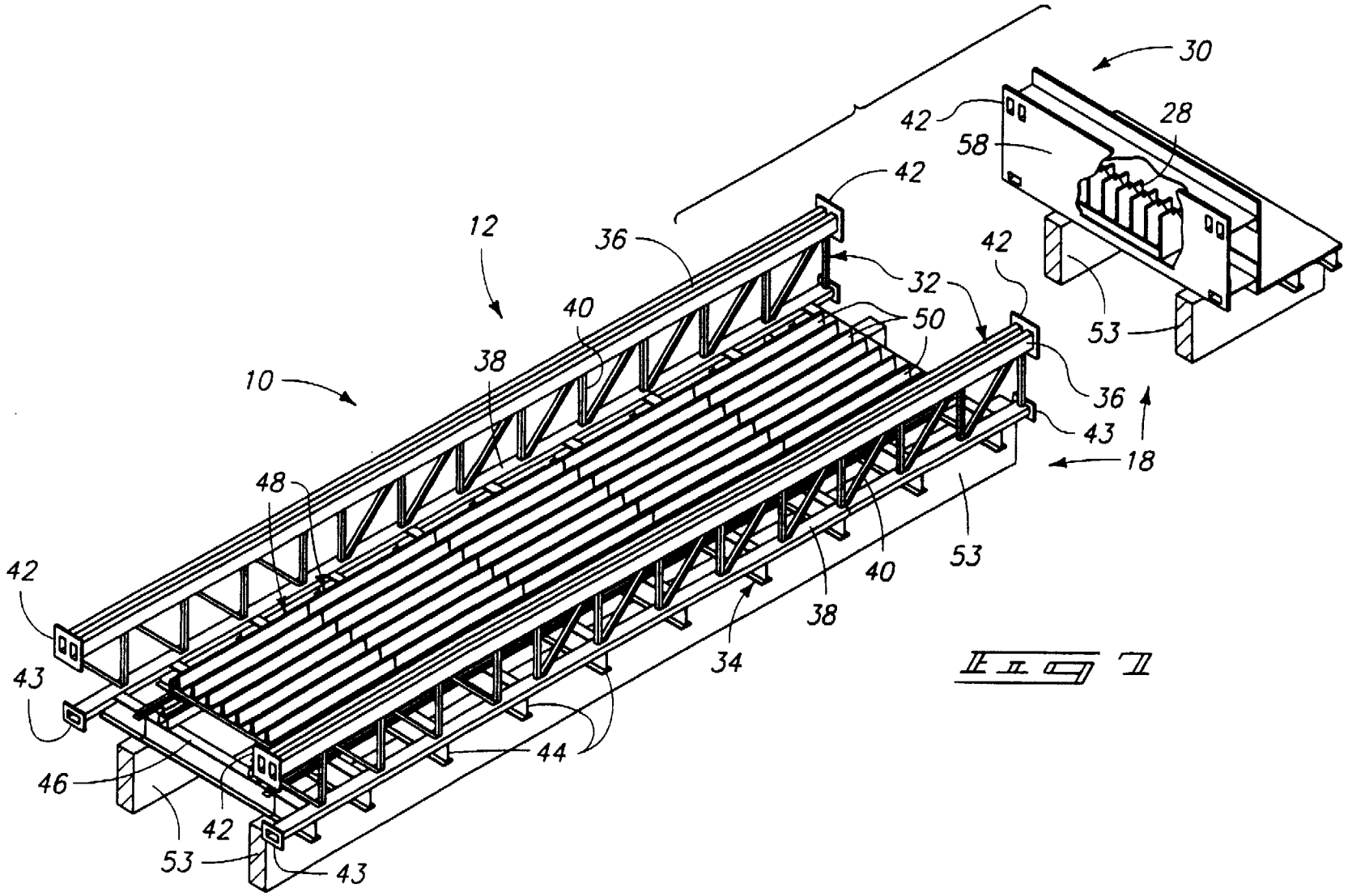
Figure 11:
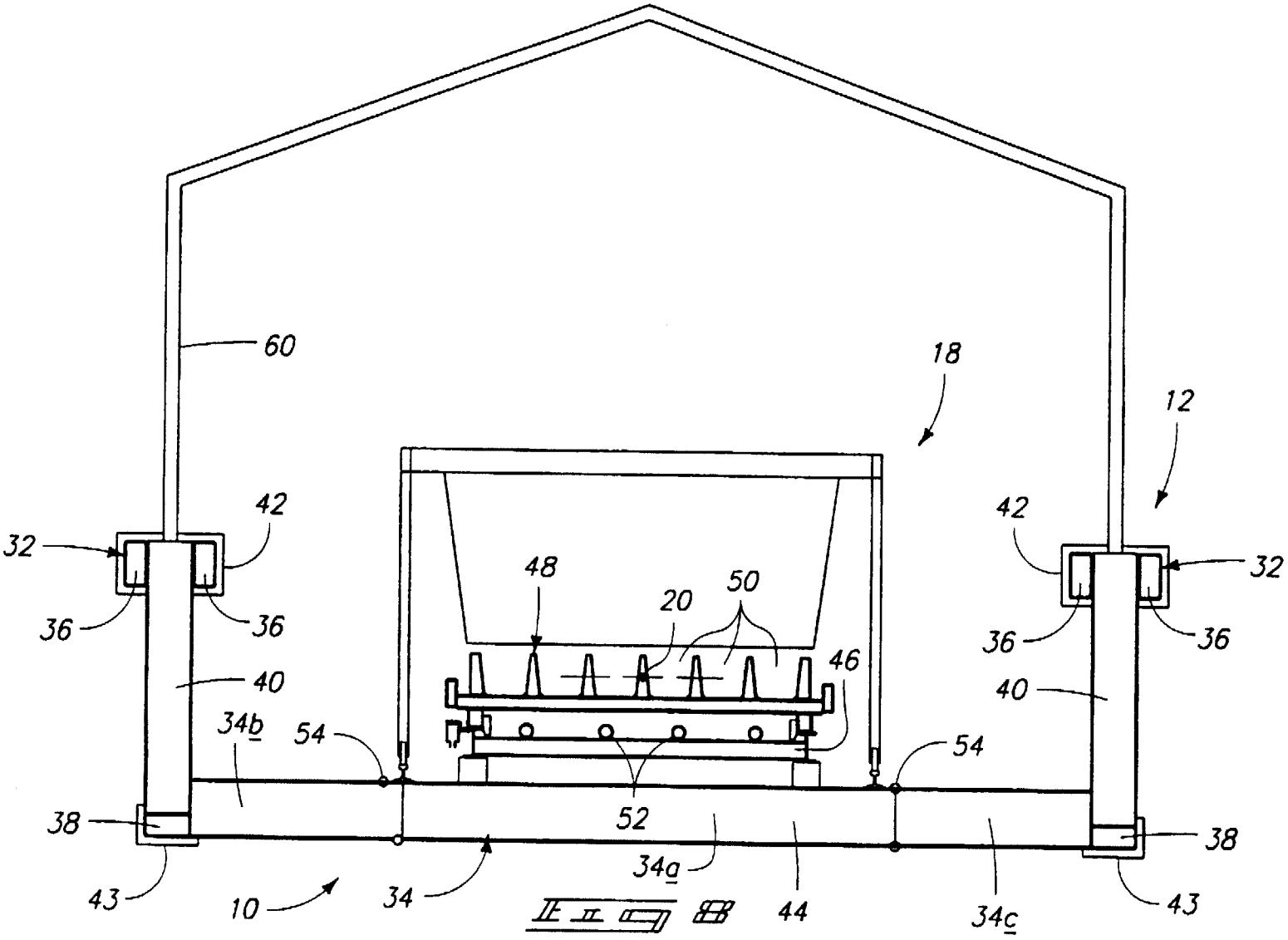

Referring to the present structure 10 in greater detail, reference is made specifically to FIGS. 6 and 7. Here a portion of the structure 10 is shown including a rigid horizontal metal stressing frame 12. The stressing frame 12 is shown in FIGS. 6 and 7 by exploded views with various sub-frame segments 18 separated. In operation, these segments 18 are joined in axial alignment to produce a unitized stressing frame 12 extending between a live end segment 26 (FIG. 6) and a dead end segment 30 (FIG. 7). Live end segment 26 is located at the live end of the frame and is provided with tensioners 24 to produce tension forces along reinforcing wires. The dead end segment 30 is situated at the dead end of the frame and is supplied with anchors 28 to anchor ends of the wires against the pulling tension produced at the frame live end.

All of the individual sub-frame segments 18, including live and dead end segments 26, 30 are releasably connected end-to-end along a horizontal tensioning centroid and plane 20. The "centroid plane 20" is a central reference plane that is shown in edge view as a horizontal line in FIG. 5. The centroid plane 20 passes through the centroid of the frame (shown as a point on the plane 20) and substantially bisects the height of the stressing frame 12 when in the operative condition. The centroid is actually the focus of a multitude of forces in tension along various reinforcing wires (not shown) that are stretched between the live and dead ends of the frame 12.

It is typical that three levels of reinforcing wires are produced for each tie (see FIG. 3). The overall number of wires that are prestressed and cast within each line of tie mold cavities will vary from 18 to 28. Since the mold cavities are positioned laterally adjacent to one another and a typical gang cavity mold will include six cavities, the overall number of reinforcing wires that are placed under tension for each pour may range between 108 and 168. Since each wire must be pretensioned to approximately 5,000 to 10,000 lbs., the stressing frame must be designed to withstand prestressing forces in the vicinity of 1 million lbs. In the prior art forms of permanent long-line tie producing facilities, (FIGS. 1, 2), these forces are eccentric to the frame and are counteracted by massive foundations using hundreds of tons of concrete and reinforcing steel. With the present system, such forces are concentric to the centroid and are accommodated by the releasably joined, above ground sub-frame segments of the present structure, which are more fully described below.

Figure 5:
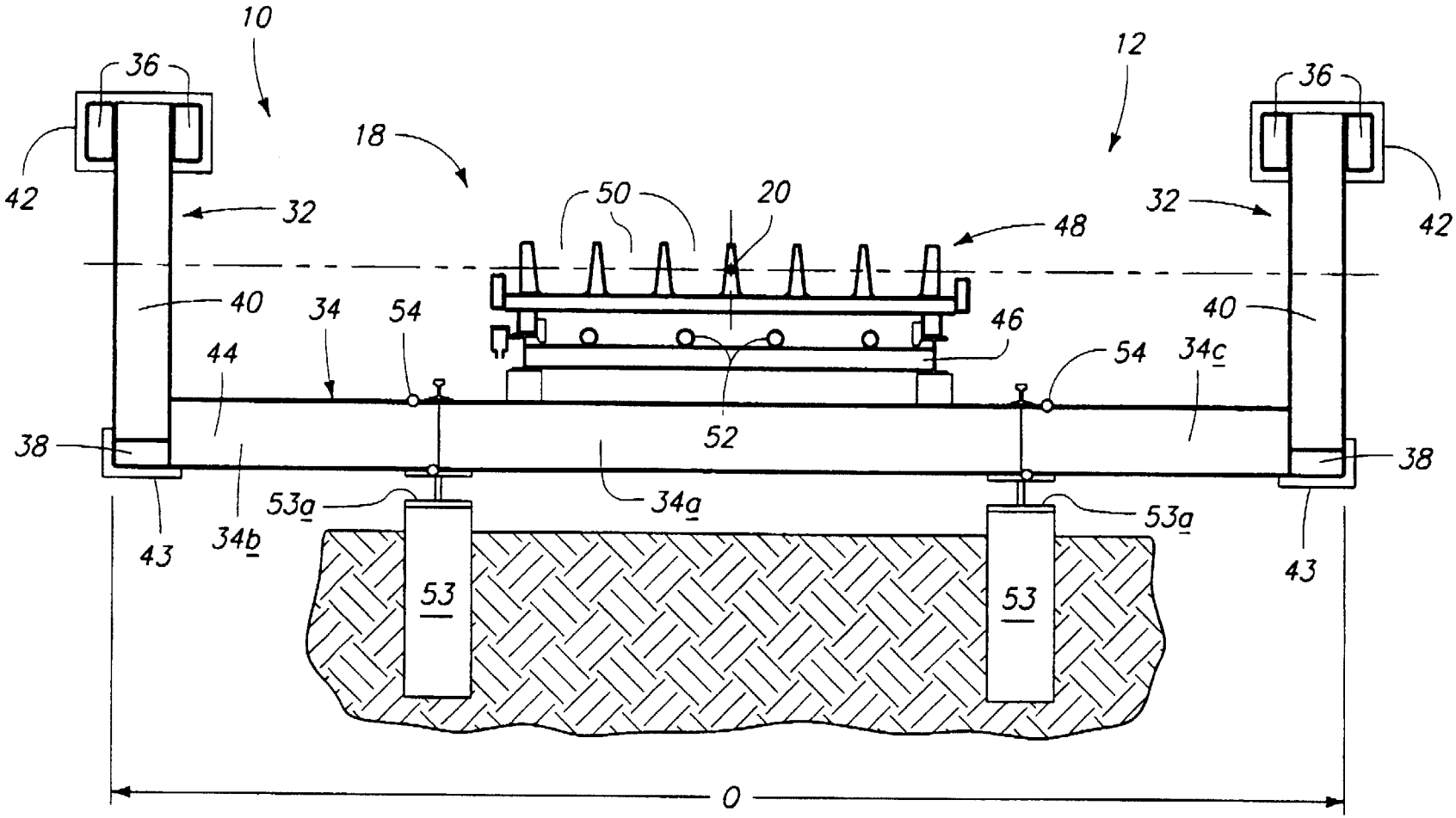
FIG. 5 is a view similar to FIG. 4 only showing the reaction members folded to an extended operative condition.

Each of the sub-frame segments 18 is provided with opposed, preferably parallel longitudinal reaction members 32. Members 32 are interconnected by cross frame members 34, producing a substantially "U" shaped cross sectional configuration as shown in FIG. 5.

The longitudinal reaction members 32 each include longitudinal top chords 36 and a parallel bottom chord 38. Chords 36 and 38 are constructed of fabricated steel and are joined by fabricated steel webbing 40. The top chords 36 are advantageously provided in horizontally spaced pairs. The pairs of top chord members 36 are interconnected by webbing 40. The horizontally spaced top chord members 36 serve to resist lateral deflection during loading.

Opposed ends of the top and bottom chords 36, 38 are provided with self-centering top and bottom alignment fittings 42, 43 that may be bolted together at the site in precise axial alignment. The reaction members 32 are thus aligned on assembly, forming long, horizontal compression columns. To minimize eccentric loading, the top and bottom chords 32, 38 are spaced substantially equal distances elevationally from the centroid plane 20 (see FIG. 5).

The top and bottom chords 36, 38, on opposite longitudinal sides of the stressing frame are parallel to one another and are spaced equally from the centroid 20 or central focus of the stressing forces applied when reinforcing wires are tensioned between the live and dead ends of the stressing frame. More specifically, the top chords 36 are situated above the centroid 20, and the bottom chords 38 are situated below the centroid 20. It is preferred that the chords on each side of the framework be spaced equal (concentric) distances above and below the centroid to avoid eccentric loading which could cause buckling of the reaction members.

Eccentrically mounted reaction members are typically used in prior art stressing frames, especially in stationary structures where the stressing frame is produced from concrete and is buried in the ground below and eccentric to the stressing equipment. The mass and structural shape of the concrete stressing frame is sufficient to withstand the eccentric loading applied during tensioning. However, the present rigid metal stressing frame is required to withstand similar forces during wire tensioning. By situating the top and bottom chords in concentricity with the centroid 20, eccentricity is eliminated and the need for massive reaction members to avoid buckling is significantly reduced.

Depending upon the number of ties required, several of the sub-frame segments 18 may be connected together between the live end segment 26 and dead end segment 30. In practice, the intermediate individual segments 18 may each have an individual overall length between opposed ends of 42 feet. This length facilitates placement of five six cavity gang molds for each segment. A maximum overall length of ten interconnected segments 18 is approximately 420 feet. Thus, 50 conventional six cavity gang tie molds can be accommodated for long-line production of 300 ties for each casting cycle. Of course, the length of the individual segments 18 may vary according to the length of ties required, and fewer segments 18 may be interconnected for low production needs.

The cross frame members 34 are comprised of a plurality of lateral beams 44 that extend transverse to the length of the stressing frame and mount the reaction members 32 at outward ends. The ends, in a preferred form, are notched to be secured as by welding to the bottom chords 38. The beams 44 may be conventional "T" beam members with top surfaces arranged in a horizontal plane and mounting a form support bed 46 for loosely and releasably supporting the gang tie molds 48. It is also noted that the beams 44 fold at hinges 54 which will be described further below.

It is of interest to note that the gang tie molds 48 may be identical to gang tie molds used in stationary long-line tie production facilities. Thus, no special tie molds are required for the present structure and conventional gang tie mold handling equipment may be acquired from conventional sources. This lends a substantial degree of flexibility to the present system and significantly reduces the cost, particularly for a concrete railroad tie producer that already makes use of such molds and handling equipment at a stationary location. The molds and handling machinery may, if need arises, be "borrowed" from the permanent facility, used in the temporary facility, then transported back for continued use in the permanent facility. Use of the conventional gang tie molds also reduces the amount of special training required to produce concrete ties using the present system.

The gang tie molds 48 preferred for use in the present invention typically include a number of individual mold cavities 50 that are arranged side by side in a transverse alignment. The ends of the mold cavities are open to facilitate end-to-end interconnection of the cavities along the operative length of the stressing frame. These aligned cavities will therefore accept reinforcing wires that extend the length of the stressing frame between the live end 14 and dead end, where they are connected to stressing apparatus at the live and dead end segments 26 and 30 respectively.

Each of the sub-frame segments 18 may be provided with a number of electrical resistance curing heater elements 52 (FIGS. 6–8). These elements 52 are, in a preferred form, fitted to a form support bed 46 on the cross members 34. Elements 52 transmit heat upwardly to the molds 48 resting on the form support bed 46. The resistance heater elements 52 may be interconnected from one segment 18 to another by conventional electrical connectors, then operated from an external power source. The use of electrical resistance heater elements 52 is an advantage in that no special sealed connections are required for operably joining the various elements together. In the past, heated oil or steam has been used for this purpose, in which the heated fluid is pumped through continuous loops of tubing. Thus, if heated oil, steam, or other pressurized fluid were to be used in the present segmental system, extra care and precaution would be required to facilitate adequate sealing of the segmental conduits required for the sub-frame segments.

Given the potential overall length of the structure 10, it can be assumed that minor misalignment may occur over the length of the structure. Such misalignment will normally result in slight eccentric forces resulting during tensioning, that could tend to cause buckling along the structure length. To counter this potential problem, longitudinal footings 53 are provided under the stressing frame. The footings 53 are preferably formed of concrete, poured at the selected site with accurately graded top surfaces to receive and support the structure. Adjustable brackets 53*a* are positioned between the segments and footings to allow elevational and lateral adjustment for alignment and bracing of the reaction members 32. The brackets 53*a* will allow longitudinal independent movement of the stressing frame to accommodate foreshortening of the frame during stressing.

No substantial compressive loading is transmitted to the footings 53 from the reaction members 32. The footings are required only to support the weight of the structure, and to brace the reaction members against lateral deflection during prestressing loading. Dimensions of the footings may thus be minimal. For example, two parallel footings one foot wide and 3–4 feet deep may be adequate depending upon stability and condition of the soil or ground conditions at the selected sites.

In a preferred form, the sub-frame segments 18 are convertible from inoperative transport conditions (FIG. 4) to extended, operative conditions (FIG. 5). Such conversion may occur simply by providing the crossframe members 34 and reaction members 32 as separate parts that may be transported separately then bolted together. However, to reduce set-up and take-down time, it is preferred that the segments be pre-assembled with connectors in the form of hinges 54 to facilitate pivotal motion of the reaction members 32 between inoperative and operative conditions. This speeds the set-up and take-down time and enables the various segments 18 to be transported as units.

Two hinges 54 are provided on each crossframe member 34, and define parallel longitudinal hinge axes. The crossframe members 34 are thus divided into three sections, a central section 34*a* for supporting the gang molds and casting machinery, and two end sections 34*b*, 34*c* that extend outwardly from the hinges 54 to mount the reaction members 32.

The hinges 54 define pivot axes that are parallel and spaced apart such that in the folded, inoperative condition (FIG. 4), the overall width of the segments 18 are acceptable for roadway travel. Preferably, the overall width dimension is less than approximately 12 feet. In one embodiment, the transport width "T" (FIG. 4) of 11 feet, 3½ inches is preferred. When folded out to the extended, operative condition (FIG. 5), the overall width "O" will be greater than 16 feet. In a preferred form, the width dimension "O" will be approximately 18 feet to accommodate various forms of equipment that may be required in the molding, de-molding, and tie transfer processes that are required in the long-line tie production process.

The hinges 54 may be conventional, heavy duty pin type hinges connecting segments 34*a*, 34*b* and 34*c* of the crossframe members 34. As shown in FIG. 5, end surfaces of the crossframe segments 34*a*, 34*b* and 34*c* will abut and lock horizontally as the reaction members reach their extended, operative conditions.

It is also noted that the footings 53 are spaced apart laterally to support the segments 18 immediately below the hinges 54. The weight of the tie forms, poured concrete and attendant equipment is thus born by central portions of the crossframe members and the footings 53.

It is noted that the live and dead end segments 26, 30 do not fold. Rather, tensioner and anchor transfer plates 56 and 58 respectively (which span the segments to engage extreme ends of the reaction members 32 during operation) may simply be turned length-wise during transport.

Plates 56, 58 are considered to be force transmission members, mounting conventional wire anchors 28 and wire tensioners 24 respectively. The transmission members 56, 58 span the respective dead and live ends of the framework and transversely connect the top and bottom chords 36, 38 across the stressing frame in order to translate forces (produced by tensioning wires within the gang tie molds on the tie form bed) to compression forces along the top and bottom chords 36, 38.

The above described structure is used in the present process described below for setting up the road transportable concrete railroad tie long-line molding system.

The first step in the present process is to provide a substantially level plant area. This step may be accomplished using ordinary excavation equipment. Alternatively, a site may be selected with a preexisting level plant area. It is pointed out that the area need not be covered since it is quite feasible to supply the present stressing frame with a shelter support frame 60 as indicated in FIG. 8. This enables the entire length of the stressing frame to be covered against sun and weather by appropriate tarps or covering materials (not shown).

It is also feasible that the present structure be assembled in an existing structure such as a warehouse where sufficient level support is provided. It is also pointed out that the plant area is selected to be in relative close proximity to the site where the concrete ties are to be installed. Such selection satisfies the need to produce the railroad ties at a location where it is economical to transport the ties to the installation site.

As a next step, foundation members (the footings 53) are poured along the selected stressing bed site at the plant area. The footings are set apart laterally by distances approximately equal to the lateral distance across the segments between the hinges 54 and extend longitudinally to support the full length of the structure when assembled. The footings 53 may be formed of poured concrete, filling formed excavations. The poured footings are allowed to cure while the components of the structure are transported to the site.

As a next step, the stressing frame is provided in which individual road transportable elongated sub-frame segments 18, live and dead end segments 26, 30 of the present structure are used. The segments 18 will convert between inoperative transport conditions and extended operative conditions. If the individual sub-frame segments 18 are not already converted to the transport condition, this step will involve lifting the reaction members 32 upwardly about the hinge axes to shift them upward and inwardly to the condition shown in FIG. 4. The sub-frame segments 18 may now be loaded onto trucks and transported to the prepared site. It is also noted that truck transportation is not a critical mode of transportation, and that the sub-frames may be transported at least through part of the distance to the prepared site by ship or rail.

As a next step, upon arriving at the selected site, the sub-frame segments are unloaded and placed on the cured footings 53. At this time, or subsequently, the reaction members 32 are converted to the extended, operative condition. This is done simply by swinging the reaction members outwardly and downwardly about their respective pivot axes. The abutting ends of the crossframe member segments will automatically stop, and can be locked at the desired, operative condition as shown in FIG. 5. Appropriate conventional cranes or other lifting and maneuvering devices may be used to accomplish this step.

The segments are placed on the footings 53 in such a manner that opposed ends of the sub-frames 18 are in abutment and the reaction members are horizontal and in longitudinal alignment and the live and dead end segments 26, 30 are positioned at the respective live and dead ends of the structure. Once accurate alignment is achieved, all segments are bolted together and the curing elements 52 are interconnected in anticipation of operation.

The live and dead end segments 26, 30 of the stressing frame are also positioned in this procedure and the force transmitting members (plates 56, 58) are positioned at the opposed ends for direct engagement with the extreme ends of the reaction members 32. The tensioners and anchor members are provided as integral parts of the respective live and dead end segments and so simply need to be attached to appropriate conventional tensioner drive apparatus (not shown) for operation.

The next step includes positioning a plurality of concrete tie molds with their upwardly open elongated mold cavities oriented longitudinally within the stressing frame between the wire tensioners and wire anchors. It is pointed out that this step may be accomplished at the site, or the gang molds may be previously positioned on the form support bed sections of the segments prior to transport. In this instance, longitudinally oriented groups of gang molds will automatically come into alignment as the segments are secured together.

This then concludes the set up operation. Steps are subsequently performed to facilitate casting of ties within the aligned molds. Such steps may involve providing power to the tensioners, and deploying equipment for use in the casting process.

Before the molds are filled with concrete, reinforcing wire is drawn along the length of the sub-frame within each of the long-lines of aligned mold cavities. This may be done in the conventional manner using equipment and process steps that are common, to a fixed, stationary casting plant. The wires are attached at the anchors adjacent the dead end of the structure and secured to the tensioners at the live end. Bulkheads are now positioned to separate the individual tie cavities. Tension is then applied by the tensioners to draw the wires tight within the aligned molds.

The tension forces applied to the wires is reacted against through the force transmission members to the reaction members 32. Because the top and bottom chords of the tension members are concentric to the centroid, no excessive lateral (eccentric) loading is produced and the force is transmitted as nearly pure compressive forces against the long reaction members. The top and bottom chords are braced by the crossframe members and footings against any slight misalignment. Thus, the reaction members will adequately and immovably accept the compressive forces without shifting or buckling.

It is pointed out that the gang molds rest freely on the form support bed 46 and are not required to react against the reinforcing wire tension. It is also pointed out that the molds and many other aspects of the process and equipment are similar if not identical to those used in permanent, stationary long-line molding facilities. Thus, there is no need for special training for personnel to operate the portable segmental plant, provided they posses experience from operating a permanent long-line facility.

Once sufficient numbers of ties have been produced at a portable lone-line plant set up in the manner described above, the individual segments may be dismantled and transported again to another site or to a home site for storage. This process simply involves reversal of the assembly process, leaving only the concrete footings in place. The footings may be quite easily removed and disposed of in an environmentally sound manner. Alternatively, the footings may be left in place if the site is to be used again at a later date.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A road transportable, segmental concrete railroad tie mold support and wire tensioning structure, comprising:

a rigid horizontal metal stressing frame including longitudinally opposed live and dead ends, and comprised of individual elongated sub-frame segments releasably connected end-to-end along a horizontal tensioning centroid;

wherein the sub-frame segments include longitudinal reaction members and cross frame members joining the reaction members together and forming a "u" shaped cross-sectional configuration;

the reaction members including longitudinal top and bottom chords;

wherein the top chords extend longitudinally along the framework above the centroid, and the bottom chords extend longitudinally along the framework below the centroid;

wherein the sub-frame segments further include alignment fittings positioned to align and form the top and bottom chords of the sub-frame segments into longitudinal compression columns;

a tie form support bed on the sub-frame segments configured to releasably support a plurality of conventional gang tie molds in end-to-end alignment along the framework and intersected by a horizontal centroid plane between the top and bottom chords;

a reinforcing wire anchor at the dead end of the framework;

a reinforcing wire tensioner at the live end of the framework positioned to receive and tension reinforcing wires along the centroid;

force transmission members mounting the wire anchor and wire tensioner and spanning the respective dead and live ends of the framework, and transversely connecting the top and bottom chords, adapted to translate forces produced by tensioned wires within gang tie molds on the tie form bed to compressive forces along the top and bottom chords.

2. A road transportable concrete railroad tie mold support and wire tensioning structure, as defined by claim 1, wherein the form support bed is configured to mount a plurality of conventional six cavity gang tie molds in axial alignment.

3. A road transportable concrete railroad tie mold support and wire tensioning structure, as defined by claim 1 further comprising electric resistance curing elements in the sub-frame segments.

4. A road transportable concrete railroad tie mold support and wire tensioning structure, as defined by claim 1 wherein the longitudinal top and bottom chords are parallel and are connected by webbing, and further comprising hinges on the crossframe members operably mounting the top and bottom chords to the cross frame members for pivotal adjustment about longitudinal adjustment axes.

5. A road transportable concrete railroad tie mold support and wire tensioning structure, as defined by claim 1 wherein the longitudinal top and bottom chords are mounted by hinges to the cross frame members for selective pivotal adjustment about longitudinal adjustment axes.

6. A road transportable concrete railroad tie mold support and wire tensioning structure, as defined by claim 1 wherein the longitudinal top and bottom chords and portions of the cross members are mounted for selective pivotal adjustment about longitudinal adjustment between inoperative and operative conditions wherein the sub-frame segments have a width dimension in the inoperative condition corresponding to wide-load clearance requirements for roadway transport.

7. A road transportable concrete railroad tie mold support and wire tensioning structure, as defined by claim 1 wherein the force transmission members include wire tensioners mounted to the segment at the live end of the stressing frame.

8. A road transportable concrete railroad tie mold support and wire tensioning structure, as defined by claim 1 wherein the force transmission members mount wire tensioners to a live end segment at the live end of the stressing frame, and wire anchors to a dead end segment at the dead end of the tensioning frame.

9. A sub-frame segment of a road transportable concrete railroad tie mold support and wire tensioning structure, comprising:

longitudinal reaction members and cross frame members joining the reaction members together, forming a "u" shaped cross-sectional configuration;

the reaction members including longitudinal top and bottom chords;

a concrete form support bed on the cross frame members configured to releasably receive and support concrete railroad tie forms at an elevation between the top and bottom chords; and connectors joining the reaction members to the cross frame members such that the reaction members may be selectively disposed to a compact transport condition or an extended operative condition;

wherein the reaction members in the extended operative condition are connected in axial alignment and are positioned in relation to the form support bed to withstand axial compressive loading without substantial lateral deflection in response to tensioning of reinforcing wires within tie forms on the form support bed.

10. A sub-frame segment of a road transportable concrete railroad tie mold support and wire tensioning structure as defined by claim 9, wherein the connectors are comprised of hinges mounting the reaction members to the form support bed for pivotal movement about parallel longitudinal pivot axes.

11. A sub-frame segment of a road transportable concrete railroad tie mold support and wire tensioning structure as defined by claim 9, wherein the reaction members are fabricated steel trusses with the top and bottom chords parallel to one another and joined by rigid webbing.

12. A sub-frame segment of a road transportable concrete railroad tie mold support and wire tensioning structure as defined by claim 9, further comprising:

electric resistance curing elements mounted in the form support bed.

13. A sub-frame segment of a road transportable concrete railroad tie mold support and wire tensioning structure as defined by claim 9, wherein the form support bed is configured to mount a plurality of conventional six cavity gang tie molds in axial alignment.

14. A sub-frame segment of a road transportable concrete railroad tie mold support and wire tensioning structure as defined by claim 9, including a lateral overall width dimension when in the compact transport condition of less than approximately 12 feet.

15. A sub-frame segment of a road transportable concrete railroad tie mold support and wire tensioning structure as defined by claim 9, including a lateral overall width dimension when in the compact transport condition of less than approximately 12 feet, to facilitate road transportation thereof, and a lateral overall width dimension greater than 14 feet when in the extended, operative condition.

16. A road transportable concrete railroad tie long-line molding system, comprising:

a rigid horizontal metal stressing frame including longitudinally opposed live and dead ends, and comprised of at least two individual road transportable elongated sub-frame segments releasably connected in axially aligned end-to-end relation between live and dead end segments;

parallel longitudinal reaction members extending along opposed sides of the sub-frame segments;

wherein the sub-frame segments are convertible from inoperative transport conditions to extended operative conditions;

footings along the stressing frame length to engage the sub-frame segments to releasably mount the sub-frame segments in axial alignment and stabilize the reaction members against lateral deflection during compressive loading;

a plurality of conventional gang tie molds having upwardly open elongated mold cavities;

a tie form bed on the sub-frame segments configured to releasably support the gang tie molds in end-to-end alignment along the framework;

a reinforcing wire anchor on the dead end segment at the dead end of the framework;

a reinforcing wire tensioner on the live end segment at the live end of the framework, positioned to pretension an array of longitudinal reinforcing wires connected between the anchors and wire tensioner, and translating the tensioning forces to compressive forces along the reaction members independently of the gang tie molds;

wherein the tensioning forces are distributed about a centroid; and wherein the reaction members are positioned in concentricity with the centroid.

* * * * *